United States Patent [19]

Kolstedt et al.

[11] Patent Number: 4,793,328

[45] Date of Patent: Dec. 27, 1988

[54] METHOD OF PRODUCING PRESSURE FOR A MULTI-CHAMBERED SLEEVE

[75] Inventors: Mark Kolstedt, Algonquin; John F. Dye, Elgin, both of Ill.

[73] Assignee: The Kendall Company, Boston, Mass.

[21] Appl. No.: 157,819

[22] Filed: Feb. 19, 1988

[51] Int. Cl.[4] ..... A61H 9/00

[52] U.S. Cl. ..... 128/24 R; 128/DIG. 10; 128/DIG. 20; 128/30.2; 128/64; 417/540

[58] Field of Search ..... 128/24 R, 40, 60, 64, 128/38, 39, DIG. 10, DIG. 20, 686, 205.26, 202.12, 28, 30, 30.2; 417/540; 425/DIG. 1

[56] References Cited

U.S. PATENT DOCUMENTS

| | | | |
|---|---|---|---|
| 2,781,041 | 2/1957 | Weinberg | 128/24 R |
| 3,177,866 | 4/1965 | Wesslund | 128/24 R |
| 3,179,106 | 4/1965 | Meredith | 128/24 R |
| 3,307,533 | 3/1967 | Meredith et al. | 128/24 R |

*Primary Examiner*—Edgar S. Burr
*Assistant Examiner*—Kimberly L. Asher
*Attorney, Agent, or Firm*—Donald N. Halgren

[57] ABSTRACT

A method of compressing a multi-chambered sleeve which is normally wrapped about a patient's arm, comprising pressurizing an accumulator from within the accumulator, opening a manifold arrangement in said accumulator in a timed manner to direct pressurized air to proper chambers in a multi-chamber sleeve.

12 Claims, 2 Drawing Sheets

METHOD OF PRODUCING PRESSURE FOR A MULTI-CHAMBERED SLEEVE

BACKGROUND OF THE INVENTION

1. Field of the Invention

This invention relates to therapeutic and prophylactic devices, and more particularly to a method for generating compressive pressures in a multi-chambered sleeve which is applicable to a patient's limb.

2. Prior Art

Velocity of the flow of blood in patient's arms and legs, particularly the legs, markedly decreases during the confinement of the patient. This slow-down in the velocity of blood in those extremities causes a pooling of stasis of blood which is particularly pronounced during surgery, immediately after surgery, and when the patient has been confined to bed for extended periods of time. The stasis of blood is a significant cause of the formation of thrombi in the patient's extremities, which would have a severe deleterious effect on the patient. Additionally, in certain patients, it is desirable to move fluid out of interstitial spaces in the tissues of their extremities, in order to reduce swelling associated with edema in those extremities, or for the treatment of ulcers caused by insufficient venous return.

U.S. Pat. No. 4,013,069 to Hasty, discloses a sequential intermittent compression device for applying compressive pressures against a patient's limb, from a source of pressurized fluid.

U.S. Pat. No. 4,338,923 shows an inflatable-cell body treating apparatus having a compressor attached to a receiver which directs the compressed air through a reduction valve then to an inlet port of a rotary distributor, eventually to an inflatable band.

U.S. Pat. No. 3,862,629 shows a fluid pressure control apparatus including a complicated oscillatory valve arranged from a supply system to an exhaust, which feeds a plurality of inflatable chambers disposed about a patient's limb.

U.S. Pat. No. 2,528,843 discloses an intermittent pressure generator comprising a piston-cylinder arrangement with a plurality of take-off tubes in communication with the cylinder, to supply pressurized fluid to a sleeve.

Some of the prior art compressive devices are expensive to manufacture, are complicated and cumbersome, and inconvenient to use, particularly in a home care environment, where sophisticated technical help is not readily available.

It is an object of the present invention to provide a method for sequentially generating fluid pressures and providing such compressive fluid to a sleeve adapted about a patient's limb.

It is a further object of the present invention to define a method for operating a small, self-contained compressive device that is easy to use and carry, with minimum inconvenience.

BRIEF SUMMARY OF THE INVENTION

The present invention comprises a sequential compression device for supplying pressure sequentially to an inflatable elongated sleeve which is utilized to pressurize a patient's limb.

The sequential compression device comprises a housing having an upper housing portion and a lower housing portion. The upper and lower housings define an accumulator. The accumulator directs pulses of pressurized air through a plurality of conduits, to the inflatable sleeve.

The lower housing has a generally flat lower surface and is surrounded on its periphery by four upstanding walls having a common planar uppermost edge.

A vacuum pump is secured to the lower surface of the lower housing and has an intake line in fluid communication with an orifice in a wall of the lower housing. The vacuum pump has a discharge orifice on the pump housing which discharges pressurized air directly into the housing that is, the accumulator. The vacuum pump is driven electrically.

An exhaust port assembly is disposed in the accumulator, adjacent the pump. The port assembly comprises a plurality of conduits, having their proximal ends internal to the accumulator.

A valve means comprising a plurality of stoppers are pivotly disposed at the proximal ends of the conduits at the exhaust port assembly. Each stopper is disposed on the distal end of an arm, which arm is biased so as to direct each stopper against its respective conduit, at the exhaust port assembly.

A ganged cam arrangement is disposed parallel to the pivotably disposed stoppers. The ganged cam arrangement is rotatively connected to a small synchronous motor. The cam arrangement controls opening and closing of the valve arrangement, more particularly, the movement of the stoppers onto and away from the conduits at the exhaust port assembly. A position indicator is attached to each stopper. Each position indicator moves with each stopper, into and out of an optical sensor. The sensor determines the location of its particular position indicator and provides feedback to a proper circuit controlling the cam drive motor and the pump drive motor.

The valve arrangement and camming means therefore could be replaced by an arrangement of solenoid valves controlled by an appropriate microcircuit.

In operation, the pump pressurizes the accumulator, when the upper housing is disposed upon the lower housing, and the proper circuitry is initiated.

The proximal ends of the conduits thus receive the pressurized air, pumped into the accumulator from the pump adjacent them, in the accumulator itself. The valves control the flow of pressurized air into the conduits, and hence into any compartmentalized sleeve in communication with the discharge port assembly through the housing.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
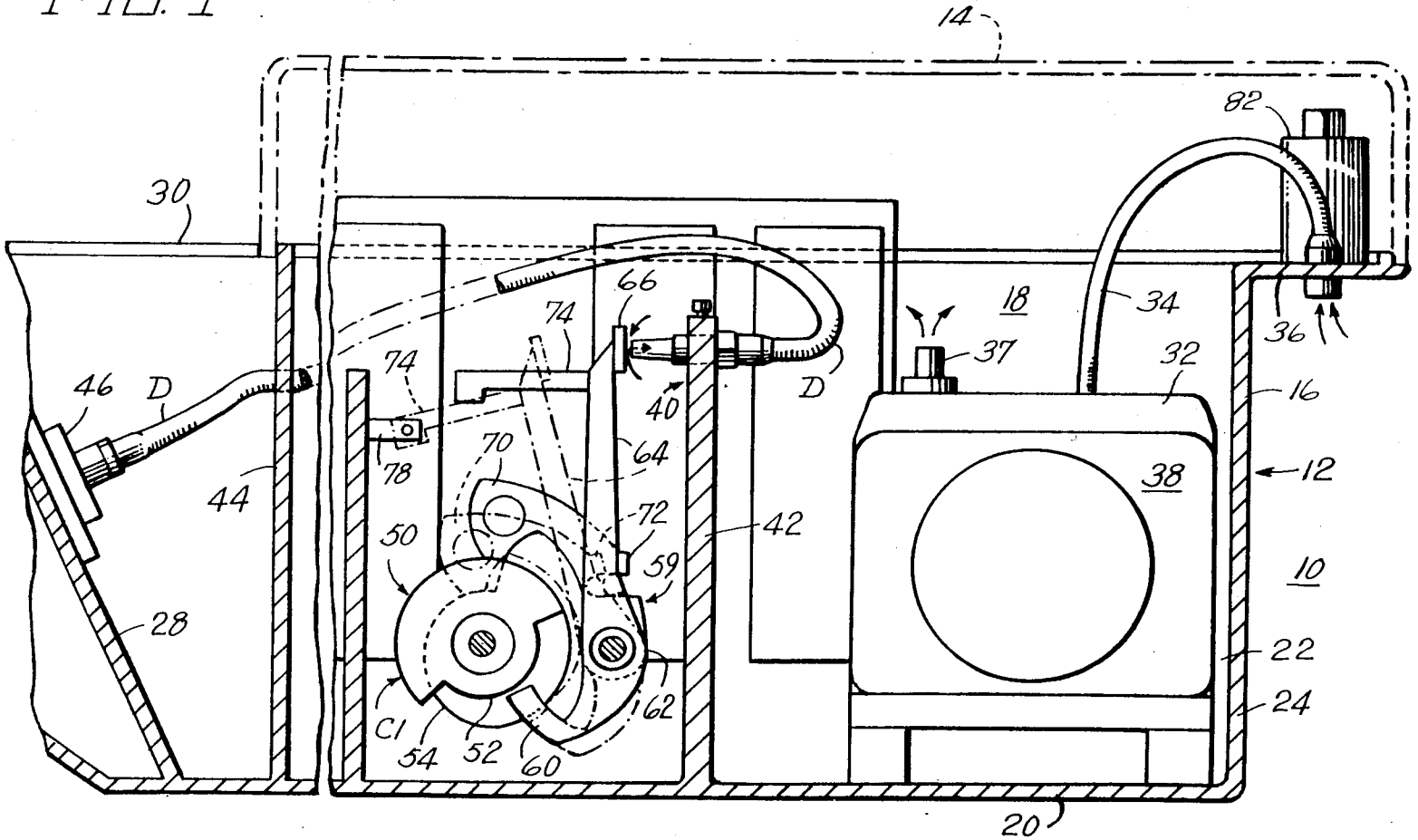
FIG. 1 is a side elevational view, partly in section of an accumulator system constructed according to the principles of the present invention.

Referring now to the drawings in detail, and particularly to FIG. 1, there is shown an sequential compression device 10 for supplying pressure sequentially to an inflatable sleeve, such as that shown in U.S. Pat. No. 4,198,961 to Arkans, and assigned to the assignee of the present invention, which patent is incorporated herein by reference.

The sequential compression device 10 comprises a housing 12 having an upper housing portion 14 and a lower housing portion 16. The upper and lower housing portions 14 and 16 define an accumulator 18 capable of containing a volume of about 3 liters of pressurized air at a pressure of at least 5 psi. The lower housing 16 ha a generally flat lower surface 20 and is surrounded on its periphery by four upstanding walls 22, 24, 26 and 28, having a common planar uppermost edge 30.

A vacuum pump 32 is secured to the lower surface 20 of the lower housing 16. The pump 32 has an intake conduit 34 which extends through a lip 36 on the rear of the lower housing 16. The conduit 34 supplies the air, which the pump 32 pressurizes, and discharges the air into the accumulator 18 through a discharge port 37 at a constant pressure. The pump 32 is rotatively driven by an electric motor 38.

An exhaust port assembly 40 is arranged within the accumulator 18 adjacent the pump 32. The port assembly 40 comprises four conduits A, B, C, and D, having their proximal ends secured within the accumulator 18 by a bracket 42. Each of the conduits A, B, C, and D, are directed through an upstanding wall 44 and proceed to a discharge port assembly 46 in the outer wall 28 in the lower housing 16.

discharge port assembly 46 would typically be matingly attached to a plurality of conduits, not shown, for supplying an inflatable sleeve, as described in the above-mentioned patent.

Figure 2:
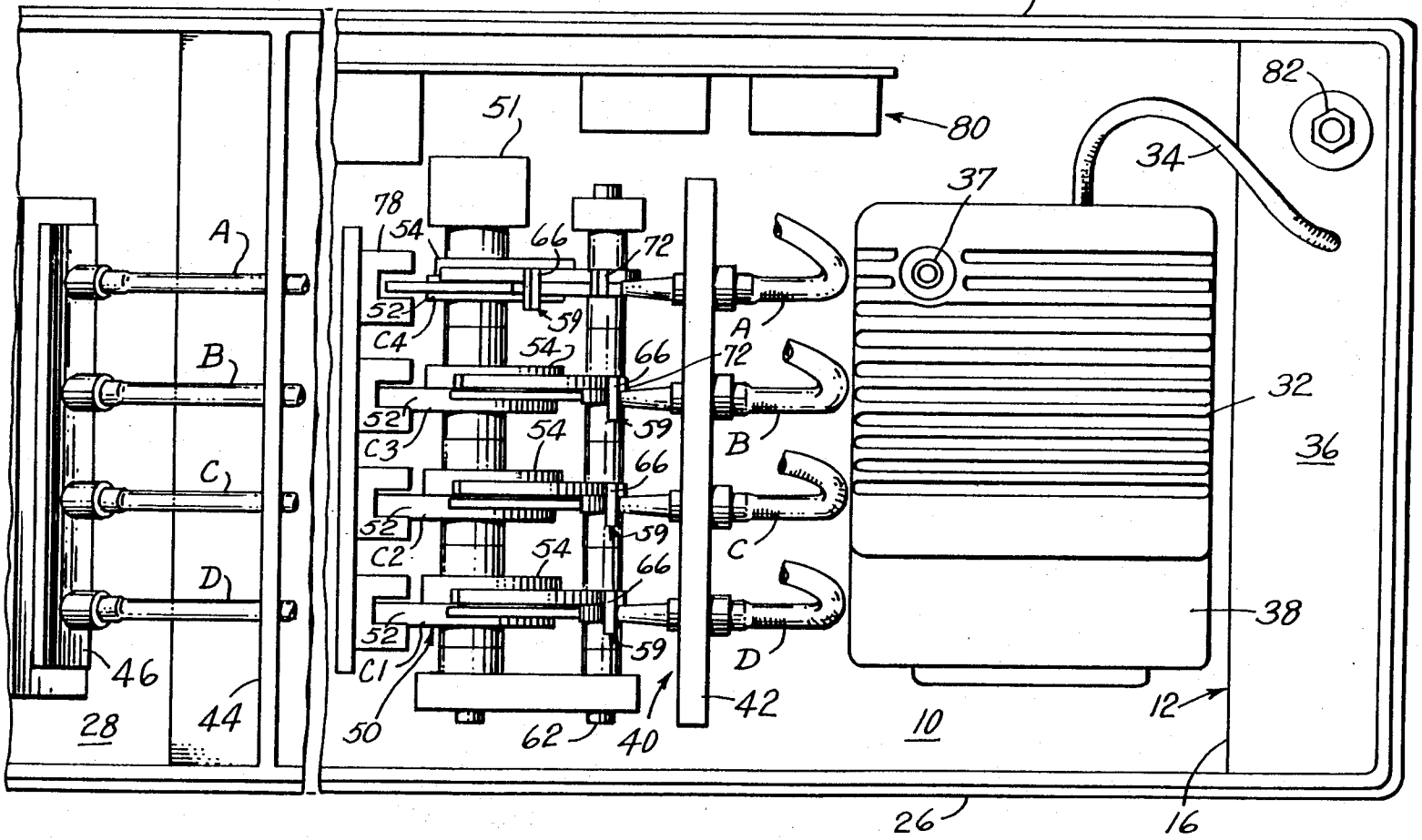
FIG. 2 is a plan view of the accumulator system shown in FIG. 1.

A ganged cam arrangement 50 is disposed parallel to the exhaust port assembly 40, and is rotatively driven by a small synchronous motor 51, as is shown in FIG. 2 The cam arrangement 50 comprises four cams, C1, C2, C3, and C4. Each cam C1, C2, C3, and C4 has a first and second cam surface 52 and 54. A valve means 59, for opening and closing the port assembly 40 comprises a main cam follower 60 biasedly pivots about a pivot in 62. The main cam follower 60 has an extended arm 64 therewith. The arm 64 has a stopper 66 which acts as a valve with respect to the proximal (open) end of its respective conduit A, B, C, or D. A second cam follower 70 is in registration with the second cam surface 54. The second cam follower 70 has a spring bias means 72 which act to push the stopper 66 away from the proximal end of its respective conduit A, B, C, and D. The extended arm 64 has a position finger 74 which is displaced, when its respective stopper 66 is displaced from its conduit A, B, C, or D. The finger 74 has a flag of its distal end which engages a detector such as an optical sensor 78. The optical sensor 78 is in communication with a proper control circuit 80, which provides proper feedback to control the electric motors 38 and 51 running the pump 32 and the cams 50 so as to properly time their operation. A dump valve 82 controls any over-pressure, and will shut off the pumps 32 through the proper control circuit and depressurize the accumulator 18, if the pressure within the accumulator 18 exceeds a certain level.

The valve means 59, could in an alternative embodiment, be comprised of a plurality of solenoid valves, not shown, which could be controlled by a proper micro chip in the control circuit 80. The electronically controlled solenoid valves would then replace the cam 50 and cam followers 60.

The air pressure within the accumulator 18 is thus caused to selectively enter the particular conduits A, B, C, or D when their respective stopper 66 is displaced therefrom. Each stopper 66 is displaced according to the angular relationship of adjacent cams C1, C2, C3 and C4 in the ganged cam arrangement 50.

A delivery conduit, not shown,, would be attachable to the discharge port assembly 46 to pressurized fluid to an attached sleeve, not shown, to permit sequential pressures to be delivered to that sleeve.

We claim:

1. A method of pressurizing a multi-chambered sleeve which is wrapped about a patient's limb, the method comprising the steps of:

pressurizing an accumulator housing with fluid;

providing a port assembly in said housing having an inlet arranged in communication with a conduit arrangement for pressurizing said multi-chambered sleeve;

sequentially opening and closing said port assembly inlet arrangement;

sequentially ducting pressurized fluid through said port assembly to said conduit arrangement for communications with said sleeve to pressurize the chambers of said sleeve.

2. A method of pressurizing a multi-chambered sleeve as recited in claim 1, including:

rotating a pump within said accumulator; and discharging said pump in said accumulator.

3. A method of pressurizing a multi-chambered sleeve as recited in claim 2, including:

moving a stopper with respect to each of said conduits of said port assembly to permit the opening and closing thereof.

4. A method of pressurizing a multi-chambered sleeve as recited in claim 3, including:

rotating a plurality of cam elements within said accumulator; and following said cam elements with cam followers to permit the moving of said stoppers which open and close said conduits.

5. A method of pressurizing a multi-chambered sleeve, as recited in claim 4, including:

detecting the position of said stoppers;

regulating the rotation of said cam elements responsive to said stopper detection.

6. A method of pressurizing a multi-chambered sleeve as recited in claim 5, including:

dumping the pressurized fluid of said accumulator when the pressure therein reaches a predetermined limit.

7. A method of pressurizing a multi-chambered pressurizable sleeve which is wrappable about a patient's limb, comprising the steps of:

pressurizing an accumulator housing with fluid under pressure by means within said housing;

sequentially discharging portions of that fluid under pressure through a conduit means to said chambers of said multi-chambered sleeve.

8. A method of pressurizing a pressurizable sleeve as recited in claim 7, including:

rotating a pump within said accumulator housing to bring fluid from outside of said housing;

discharging said pump in said accumulator housing;

housing a port assembly within said accumulator housing to effectuate the discharge of pressurized fluid from said accumulator housing.

9. A method of pressurizing a pressurizable sleeve as recited in claim 8, including:

timing the opening of conduits in said port assembly as to sequentially the portions of pressurized fluid from said housing accumulator.

10. A method of pressurizing a pressurizable sleeve as recited in claim 9, including:

closing said conduits in said port assembly in a timed sequential manner so as to stop the discharge of pressurized fluid from said accumulator housing.

11. A method of pressurizing a pressurizable sleeve as recited in claim 10, including:

governing the opening and closing of said port assembly conduits by a detector means.

12. A method of pressurizing a pressurizable sleeve as recited in claim 11, including:

dumping the pressurized fluid from said accumulator housing by a dump valve if the pressure within said accumulator exceeds a pre-set limit.

* * * * *